US006035553A

United States Patent [19]

Mercier

[11] Patent Number: 6,035,553

[45] Date of Patent: Mar. 14, 2000

[54] FOOTWEAR WITH INTEGRAL BUBBLE GENERATOR

[76] Inventor: Lynn Mercier, P.O. Box 1505, Ormond Beach, Fla. 32175

[21] Appl. No.: 09/294,742

[22] Filed: Apr. 19, 1999

[51] Int. Cl.[7] ..... A43B 19/00

[52] U.S. Cl. ..... 36/1

[58] Field of Search ..... 36/3 R, 3 B, 1, 36/29, 112, 116, 139

[56] References Cited

U.S. PATENT DOCUMENTS

| | | | |
|---|---|---|---|
| 2,863,230 | 12/1958 | Cortina | 36/3 B |
| 4,158,922 | 6/1979 | Dana, III | 36/137 |
| 4,186,502 | 2/1980 | Foster | 36/136 |
| 4,253,254 | 3/1981 | Gill | 36/139 |
| 4,610,099 | 9/1986 | Signori | 36/3 B |
| 4,787,100 | 11/1988 | Jonat | 36/112 X |
| 4,835,883 | 6/1989 | Tetrault et al. | 36/3 R |
| 5,058,293 | 10/1991 | Villar | 36/136 |
| 5,159,768 | 11/1992 | Longo, Jr. | 36/139 |
| 5,185,942 | 2/1993 | Decker | 36/1 X |
| 5,353,525 | 10/1994 | Grim | 36/3 B |
| 5,379,533 | 1/1995 | Swartz | 36/136 |
| 5,461,814 | 10/1995 | Reid et al. | 43/1 |
| 5,471,768 | 12/1995 | Pryor | 36/3 R |
| 5,564,201 | 10/1996 | O'Connell | 36/3 R |
| 5,615,111 | 3/1997 | Raskas et al. | 364/410 |
| 5,649,376 | 7/1997 | Lecates, Jr. | 36/137 |
| 5,921,003 | 7/1999 | Kim | 36/3 B |

*Primary Examiner*—B. Dayoan
*Attorney, Agent, or Firm*—Paul S. Rooy

[57] ABSTRACT

A footwear with integral bubble generator comprising a bubble generator installed below a shoe insole. When the footwear wearer puts weight on the insole, the insole presses against the bubble generator, and bubbles are emitted from a bubble generator reservoir through a nozzle. The bubble generator comprises a fill aperture sealed with a removable fill aperture cover. Bubble solution may be poured into (or out of) the bubble generator reservoir through the fill aperture. The bubble generator may optionally comprise a one-way air valve and/or a one-way nozzle valve. The one-way air valve closes during a compression step, thus forcing bubble solution fluid to exit through the nozzle, and allows air to enter the bubble generator reservoir during an expansion step. The nozzle valve prevents air from entering the bubble generator reservoir during the expansion step. The bubble generator emits bubbles through the nozzle when the wearer of the footwear exerts pressure on the bubble generator by means of the footwear insole, as when walking, jogging, running, dancing, etc.

11 Claims, 2 Drawing Sheets

FOOTWEAR WITH INTEGRAL BUBBLE GENERATOR

BACKGROUND OF THE INVENTION

1. Field of the Invention

This invention relates to footwear, and in particular to a footwear with integral bubble generator.

2. Background of the Invention

It is uncertain when footwear use first commenced. It is probable that the first foot coverings in cold climates consisted of animal fur wrappings. In warm climates, the first footwear was sandals made of plant fibers or leather. The ancient Egyptians wore such footwear as early as 3700 B.C.; in their time the Greeks and Romans followed suit. Occasionally, soft leather shoes were worn.

In China, wooden-soled shoes were worn thousands of years ago, and the Indians of North America used moccasins of animal skins before the Europeans first arrived. Most New World settlers wore sturdy leather shoes, although some used the native moccasins.

Until the 1800's, shoes were made with simple hand tools. Improved sewing machines were developed during the late 1800's, and helped turn shoemaking into a factory operation. In 1882 Jan Ernst Matzeliger, a worker in a Massachusetts shoe factory, invented the shoe-lasting machine, which greatly facilitated shoemaking. With the automation of shoemaking, the price of footwear fell dramatically, and their availability increased accordingly.

Since ancient times, shoes have not only been worn for protection, but also for decoration and to indicate social status. For example, Western Europeans wore shoes with long, pointed toes for several centuries until the 1500's. Women's shoe fashions changed to rounded toes during the 1500's, low heels by the late 1500's, and to high heels during the 1600's.

Today, shoes are still worn for protection, to indicate social status, and for fashion reasons. In addition, many novelty type shoes have surfaced in recent years, including lighted shoes, sound-generating shoes, and scent-emitting shoes.

Existing Designs

Some examples of these novelty shoes include Pryor, granted U.S. Pat. No. 5,471,768 for a Sneaker With Built In Atomizer For Improved Traction, and Lecates, Jr., who was granted U.S. Pat. No. 5,649,376 for a sneaker which simulated the sight and sound of a snake.

Other examples of novelty shoes include Raskas et al., who were granted U.S. Pat. No. 5,615,111 for a record and playback means for footwear, and Reid et al., who received U.S. Pat, No. 5,461,814 for a scent dispenser which could be removably mounted to a boot and be used to emit an animal-attracting scent, or to disguise the scent of human beings. Other U.S. Patents were granted to Decker and Longo (U.S. Pat. Nos. 5,185,942 and 5,159,768) for a sandal integrating a lotion container, and for a shoe with a music generating unit in its tongue, respectively.

On the lighter side, Villar was granted U.S. Pat. No. 5,058,293 for novel footwear which incorporated an animated face with movable eyes. And for the night club crowd, Dana, III was granted U.S. Pat. No. 4,158,922 for Flashing Discoshoes, which incorporated a solid state oscillator circuit for flashing a shoe-mounted light on and off; the shoes could also be set to flash to the time of the wearer's dance steps!

SUMMARY OF THE INVENTION

Accordingly, it is an object of the present invention to provide a footwear with integral bubble generator which automatically dispenses bubbles when weight is exerted upon it. Design features allowing this object to be accomplished include a bubble generator having resilient bubble generator walls, a bubble generator reservoir, and a nozzle. Advantages associated with the accomplishment of this object include amusement and ease of operation.

It is another object of the present invention to provide a footwear with integral bubble generator which is easy to clean and to maintain. Design features allowing this object to be accomplished include a bubble generator reservoir communicating with the outside through a fill aperture sealed by an easily removable fill aperture cover. Benefits associated with the accomplishment of this object include the ability to quickly and easily empty bubble solution out of the bubble generator reservoir when bubbles are not desired, as well as the hygiene benefits associated with the ability to easily rinse bubble solution out of the bubble generator reservoir.

It is still another object of this invention to provide a footwear with integral bubble generator which is part of the footwear itself. Design features enabling the accomplishment of this object include a bubble generator which is built into the outsole or heel of the footwear. An advantage associated with the realization of this object is a neat and aesthetically pleasing installation.

It is yet another object of this invention to provide a footwear with integral bubble generator which is inexpensive to manufacture and sell. Design features allowing this object to be achieved include the use of components made of readily available materials. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Two sheets of drawings are provided. Sheet one contains FIG. 1. Sheet two contains FIGS. 2, 3 and 4.

DETAILED DESCRIPTION OF THE PREFERRED EMBODIMENT

Figure 1:
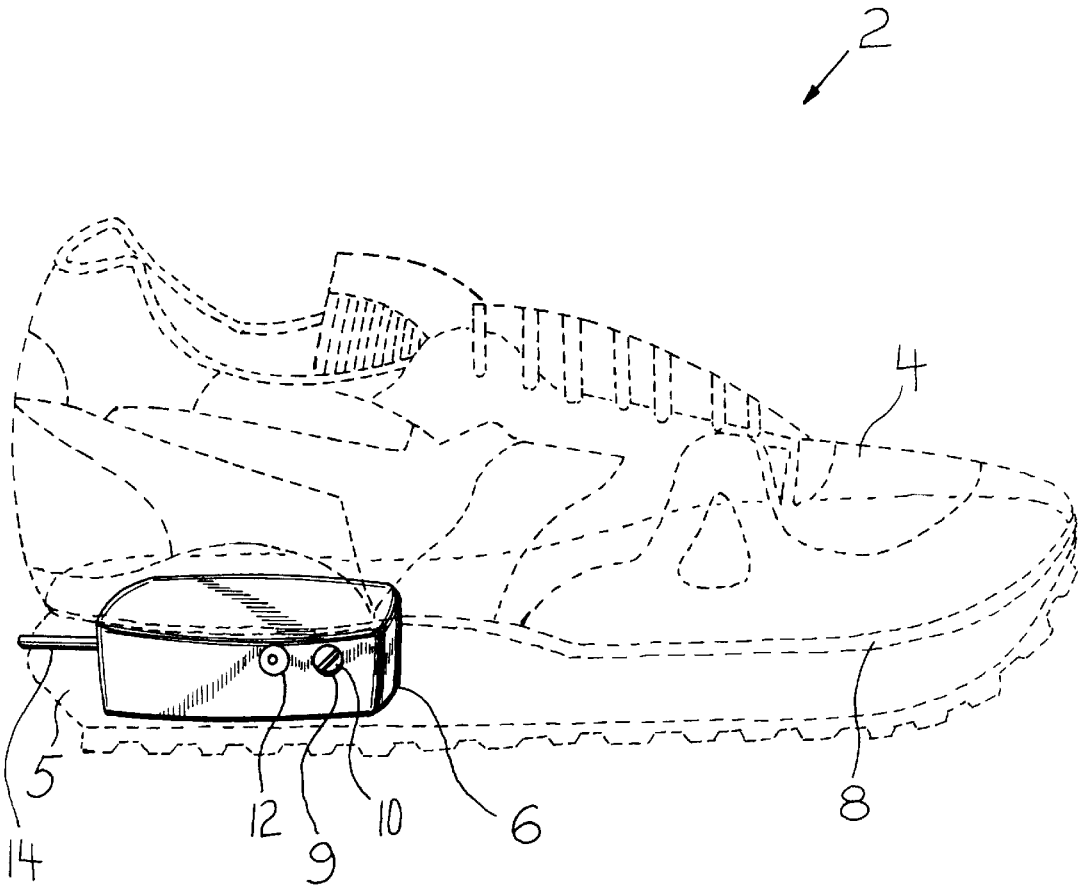
FIG. 1 is a side isometric view of a footwear with integral bubble generator.

FIG. 1 is a side isometric view of footwear with integral bubble generator 2. Footwear with integral bubble generator 2 comprises footwear 4 having footwear insole 8 and footwear heel 5. Bubble generator 6 is disposed beneath footwear insole 8, so that bubble generator 6 is compressed when a wearer of footwear 4 puts his weight on footwear insole 8.

Figure 2:
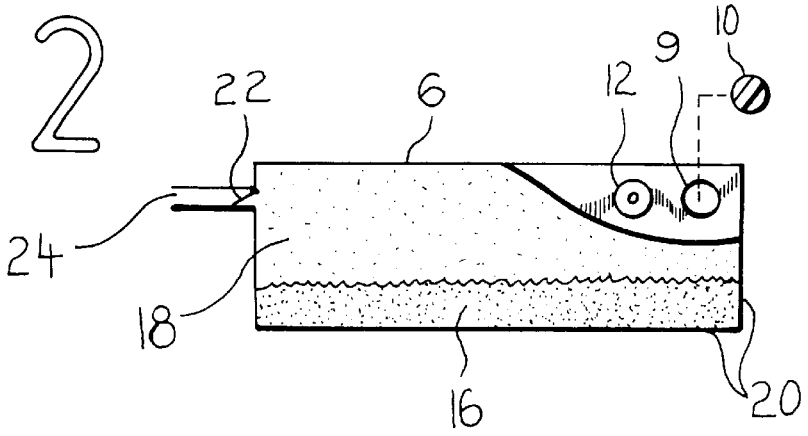
FIG. 2 is a side cross-sectional view of a bubble generator in the fully expanded configuration.

Referring now also to FIG. 2, bubble generator 6 comprises fill aperture 9 sealed by removable fill aperture cover 10. Bubble solution 16 is poured through fill aperture 9 and into bubble generator reservoir 18 for use in generating bubbles, and may be poured out of bubble generator reservoir 18 through fill aperture 9 to empty bubble generator 6 of bubble solution 16, and when cleaning bubble generator 6. Fill aperture cover 10 may comprise a male thread sized to thread into a corresponding female thread in fill aperture 9, or fill aperture cover 10 may be a cam type closure, or any other appropriate configuration. Many pressure vessel closures are old and known in the art, and could be used for this purpose in the instant invention.

Bubble generator 6 further comprises nozzle 14 extending outside of footwear 4. Bubble generator reservoir 18 communicates with the outside through nozzle 14. In use, bubble generator 6 emits bubbles 28 through nozzle 14.

Bubble generator 6 may optionally comprise air valve 12 and/or nozzle valve 22. Air valve 12 is a one-way valve which permits air to enter bubble generator reservoir 18 during the expansion step, as indicated by arrow 32 in FIG. 4. Nozzle valve 22 is a one way valve which permits bubbles to be emitted during the compression step as indicated by arrow 34 in FIG. 3, but which closes during the expansion step to prevent air from coming into bubble generator reservoir 18 during the expansion step, as illustrated by FIG. 4. Air valve 12 and nozzle valve 22 may be flapper type valves, or any other type of one-way valve known in the art for this purpose in the instant invention.

Bubble generator 6 comprises bubble generator walls 20 which enclose bubble generator reservoir 18. Bubble generator walls 20 are made of resilient material which, spring-like, tend to return to their original shape after being deformed. For example, after the compression step illustrated in FIG. 3, when pressure brought to bear on bubble generator 6 is relieved, bubble generator 6 tends to return to its original expanded shape as is illustrated in FIG. 2.

Bubble generator 6 may also optionally comprise nozzle cap 36, as illustrated in FIG. 4. Nozzle cap 36 seals nozzle 14 so as to prevent unwanted generation of bubbles (e.g during formal dinners, at church, when marching down the aisle to receive one's diploma during a graduation ceremony, when approaching the receiving line at a reception to meet the Queen, etc.) Nozzle cap 36 may comprise a female thread sized to thread onto a corresponding male thread on nozzle 14, or nozzle cap 36 may be a cam type closure, or any other appropriate configuration. Many pressure vessel closures are old and known in the art, and could be used for this purpose in the instant invention.

Figure 3:
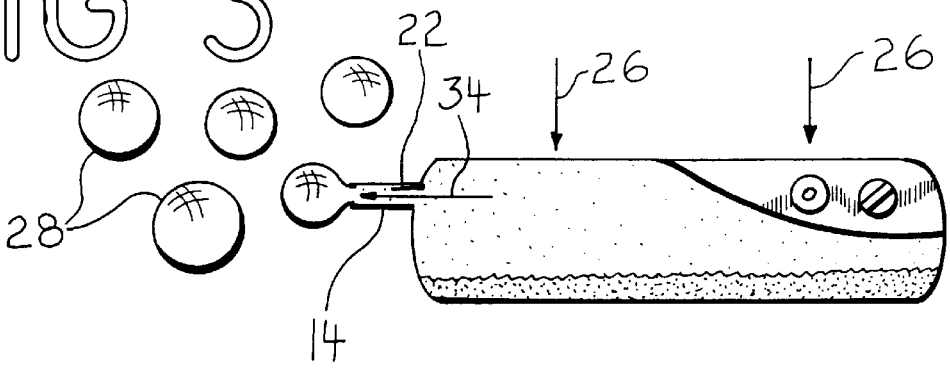
FIG. 3 is a side cross-sectional view of a bubble generator during the compression step, emitting bubbles.
Figure 4:
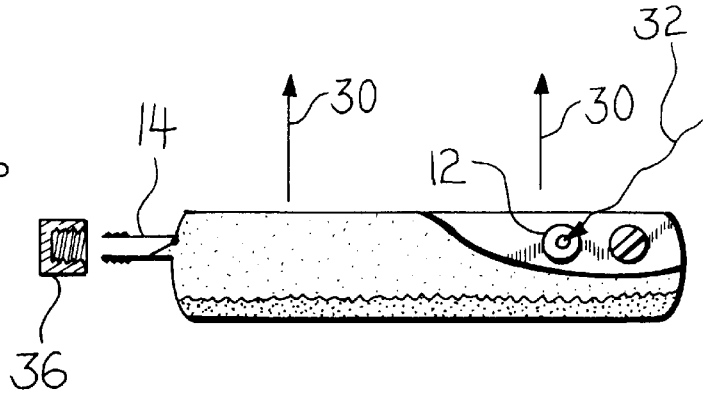
FIG. 4 is a side cross-sectional view of a bubble generator after the compression step, ready to expand again.

FIGS. 2 through 4 illustrate the bubble-generating steps of compression and expansion. The compression step occurs when the wearer of footwear 4 puts his weight on footwear insole 8, thus compressing bubble generator 6 as indicated by arrows 26. The expansion step occurs when the wearer of footwear 4 puts his weight on his other foot and relieves pressure on footwear insole 8, thus allowing the resiliency of the material of which bubble generator 6 is made to expand bubble generator 6 as indicated by arrows 30 in FIG. 4, into the expanded position shown in FIG. 2.

FIG. 2 is a side cross-sectional view of bubble generator 6 in the fully expanded configuration. FIG. 3 is a side cross-sectional view of bubble generator 6 during the compression step, emitting bubbles 28 through nozzle 14 and nozzle outlet 24. FIG. 4 is a side cross-sectional view of bubble generator 6 at the end of the compression step, ready to expand into the position shown in FIG. 2.

During the compression step, the wearer of footwear 4 puts his weight on footwear insole 8, which compresses bubble generator 6. One-way air valve 12 closes, and the only escape route for fluid contained within bubble generator reservoir 18 is through nozzle 14. The normal walking, jogging or running movements imposed on footwear 4 by its wearer agitate bubble solution 16 within bubble generator reservoir 18 so that its emission through nozzle 14 creates bubbles.

During the compression step, fluid within bubble generator reservoir 18 exits bubble generator reservoir 18 through one-way nozzle valve 22 and nozzle 14 into the exterior, in the form of bubbles 28. The compression step is illustrated in FIG. 3.

At the end of the compression step, the wearer of footwear 4 steps on his other foot, and pressure is relieved on bubble generator 6. The resiliency of the material from which bubble generator 6 is constructed urges bubble generator 6 back into its expanded position. One-way air valve 12 opens to permit air to flow into bubble generator reservoir 18 as indicated by arrow 32, and one-way nozzle valve 22 closes to prevent further flow through nozzle 14, as shown in FIG. 4. At the conclusion of the expansion step, which takes place during a single step of the wearer of footwear 4, bubble generator 6 has returned to the expanded position illustrated in FIG. 2.

In this fashion, during alternating steps by the wearer of footwear 4, bubble generator 6 alternately emits bubbles 28 during the compression step, and expands to its original size during the extension step. A bubble generator 6 may be disposed in each footwear of a pair of footwear worn by the wearer of footwear 4. In this case, bubbles 28 will be generated at each step by alternating footwear 4 worn by the wearer of footwear 4 as he walks, jogs, runs, dances, hops, etc.

While a preferred embodiment of the invention has been illustrated herein, it is to be understood that changes and variations may be made by those skilled in the art without departing from the spirit of the appending claims.

DRAWING ITEM INDEX

2 footwear with integral bubble generator
4 footwear
5 footwear heel
6 bubble generator
8 footwear insole
9 fill aperture
10 fill aperture cover
12 air valve
14 nozzle
16 bubble solution
18 bubble generator reservoir
20 bubble generator wall
22 nozzle valve
24 nozzle outlet
26 arrow
28 bubble
30 arrow
32 arrow
34 arrow
36 nozzle cap

I claim:

1. A footwear with integral bubble generator comprising:

an article of footwear having a footwear insole; and a bubble generator disposed within a footwear sole under said insole, such that when a wearer of said footwear puts weight on said footwear insole, said insole is pressed against said bubble generator and said bubble generator compresses for emitting bubbles, said bubble generator comprising a bubble generator reservoir, a nozzle communicating with said bubble generator reservoir, and a fill aperture sealed with a removable fill aperture cover, said bubble generator reservoir communicating with the outside of the footwear through said nozzle and said fill aperture.

2. The footwear with integral bubble generator of claim 1 wherein said bubble generator is made of resilient material, whereby said bubble generator will expand to its original shape after being compressed.

3. The footwear with integral bubble generator of claim 2 wherein said bubble generator further comprises an air valve through which said bubble generator reservoir communicates with the outside, whereby air may enter said bubble generator reservoir during an expansion step.

4. The footwear with integral bubble generator of claim 2 wherein said nozzle further comprises a nozzle valve, whereby flow through said nozzle is prevented during an expansion step.

5. The footwear with integral bubble generator of claim 2 wherein said nozzle further comprises a nozzle cap, said nozzle cap being removably installed on a nozzle outlet on an extreme of said nozzle opposite said bubble generator, whereby unwanted flow though said nozzle is prevented.

6. The footwear with integral bubble generator of claim 2 further comprising bubble solution in said bubble generator reservoir, whereby bubbles may be generated and emitted through said nozzle during a compression step.

7. A footwear with integral bubble generator comprising:

an article of footwear having a footwear insole; and a bubble generator disposed beneath said footwear insole, said bubble generator comprising a bubble generator reservoir contained within bubble generator walls, said bubble generator reservoir communicating with the outside of the footwear through a nozzle and a fill aperture, said fill aperture being sealed with a removable fill aperture cover, said bubble generator walls being made of resilient material whereby said bubble generator will expand to its original shape after being compressed.

8. The footwear with integral bubble generator of claim 7 wherein said bubble generator further comprises an air valve and a nozzle valve, said bubble generator reservoir communicating with the outside via said air valve and said nozzle valve, said air valve remaining closed during a compression step and opening during an expansion step, and said nozzle valve remaining closed during said expansion step and opening during said compression step.

9. The footwear with integral bubble generator of claim 8 wherein said nozzle further comprises a nozzle cap, said nozzle cap being removably installed on an extreme of said nozzle opposite said bubble generator, whereby unwanted flow though said nozzle is prevented.

10. The footwear with integral bubble generator of claim 9 further comprising bubble solution in said bubble generator reservoir, whereby bubbles may be generated and emitted through said nozzle during said compression step.

11. The footwear with integral bubble generator of claim 10 wherein said bubble generator is disposed within a heel of said footwear, and said nozzle points backwards from said footwear heel portion.

* * * * *